United States Patent [19]

Lundin

[11] 4,375,702

[45] Mar. 8, 1983

[54] DEVICE FOR MOUNTING AN EARMUFF ON A HELMET

[75] Inventor: Tord R. Lundin, Billesholm, Sweden

[73] Assignee: Gullfiber AB, Billesholm, Sweden

[21] Appl. No.: 274,522

[22] Filed: Jun. 17, 1981

[30] Foreign Application Priority Data

Jun. 23, 1980 [SE] Sweden ..... 8004624

[51] Int. Cl.[3] ..... A42B 3/00; A42B 1/24

[52] U.S. Cl. ..... 2/423; 2/209; 179/156 R

[58] Field of Search ..... 2/423, 209, 6, 422, 2/10; 179/156 R; 181/126, 129, 136

[56] References Cited

U.S. PATENT DOCUMENTS

| | | | |
|---|---|---|---|
| 3,721,993 | 3/1973 | Lonnstedt | 2/209 X |
| 4,027,341 | 6/1977 | Patteri | 2/209 X |
| 4,287,614 | 9/1981 | Lonnstedt | 2/423 |

*Primary Examiner*—Peter P. Nerbun

*Attorney, Agent, or Firm*—Shlesinger, Fitzsimmons & Shlesinger

[57] ABSTRACT

An attachment device in the form of a bearing housing (10) and an arm (38) projecting out through an opening (44) in the housing. The arm is supported in a bearing support (42) in the housing and serves to carry, at the end opposite the housing, an ear muff to move with a rocking motion between a stationary rest position and a position wherein the earmuff exerts a pressure around the wearer's ear. A separate spring component (44), preferably annular in form, is rotatably supported in and prestressed to bear against, on one side, an adjustable spring support (48), which is located inside the housing and remains stationary during the rocking motion, and, on the opposite side, the end (52) of the arm (38) located inside the housing. By this arrangement there is exerted on the said end of the arm a controlled force directed away from the spring support (48) for the purpose of stabilizing the arm in its two positions. The spring support may consist of a rocker, the position of that part (56) of the rocker in which the spring component is supported being adjustable against an adjusting means (16) with respect to the nearer end of the arm to permit alteration of the prestressing of the spring component. The adjusting means consists of a cover (16) with an annular collar (30) of thickness varying along the extent thereof. The collar rests against the inside of the ring flange (32) of a base (12), which is rotatable with respect to the said adjusting cover.

9 Claims, 3 Drawing Figures

Fig. 1A
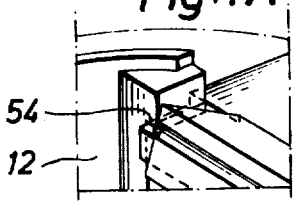
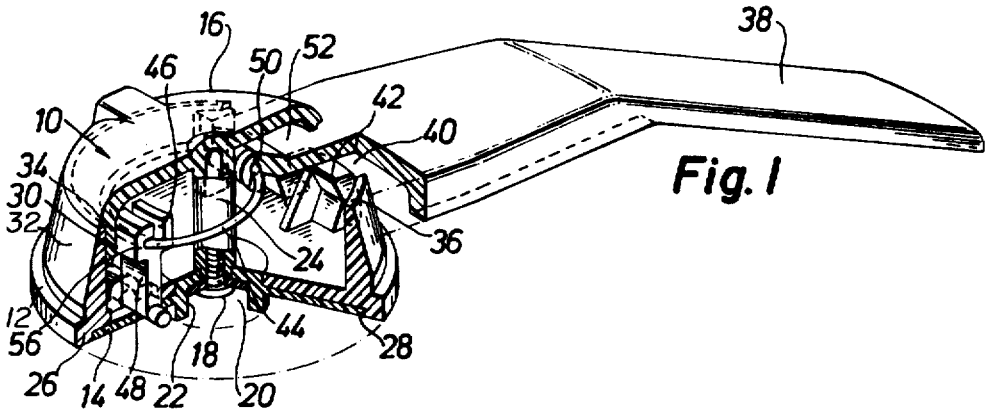
Fig. 1
Fig. 2
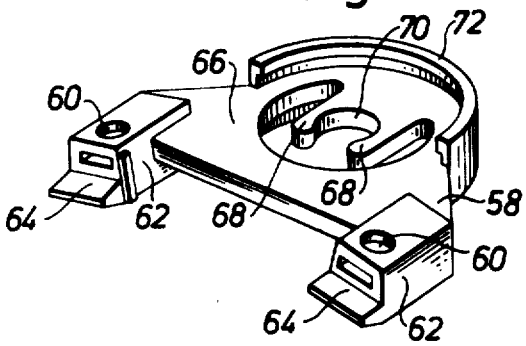

DEVICE FOR MOUNTING AN EARMUFF ON A HELMET

The present invention is concerned with an attachment device including a bearing housing designed for mounting on a helmet, and an arm which projects out through an opening in the said housing, is supported in an arm support therein, and serves to carry, at the end opposite the housing, an ear muff to move with a rocking motion between a stationary rest position and a position wherein the earmuff exerts a given desired pressure around the wearer's ear.

A number of attachment devices of the above-mentioned type are known, but they all share the drawback that the pressure exerted by the muff around the ear is preset and cannot be varied. As a result of differing helmet designs and the differing shapes of the wearer's heads it has been found that the earmuff does not always exert the desired pressure round the ear. If the wearer's head is very round the pressure may be excessive, while if the head is more oval in shape the pressure may be too small for the muff to provide an effective seal.

A further objective of the invention is, consequently, to provide a device of the type set forth in the ingress, which will obviate the above-mentioned drawback and which, moreover, is easily assembled, being fixed to and removed from the helmet by simple means.

An attachment device of the type set forth in the ingress, which meets the requirements mentioned and is moreover of simple design and suitable for mass production, is primarily characterized, according to the invention, in that a separate spring component is rotatably supported in and prestressed to bear against, on one side, an adjustable spring support, which is located inside the housing and remains stationary during the rocking motion, and, on the opposite side, the end of the arm located inside the housing, thus exerting upon the said end of the arm a controlled force away from the spring support for the purpose of stabilizing the arm in its two positions. In a preferred embodiment of the invention the spring component consists of a ring, preferably of metal. The spring support consists of a rocker and the position of that part of the rocker in which the spring component is supported is adjustable against an adjusting means with respect to the nearer end of the arm to permit alteration of the prestressing of the spring component. The adjusting means preferably consists of a cover having an annular collar of thickness varying along the extension thereof and bearing on the inside of the ring flange of a base, which is rotatable with respect to the said adjusting cover. The attachment device further comprises an adapter screwed directly to the helmet, and the bearing housing and adapter are connected by means of a hub projecting from the housing and designed to be retained by the grasping action of matching, resilient ears in the adapter, one section of the circumference of the base resting in a matching guiding flange which projects from the adapter.

The invention will be more particularly described below in the form of a preferred embodiment with reference to the accompanying drawings.

FIG. 1 shows the new attachment device in perspective, partly cut away to illustrate the parts essential to the invention.

FIG. 1A is a greatly enlarged portion of the device as shown in FIG. 1.

FIG. 2 shows in perspective an adapter belonging to the attachment device of FIG. 1 and designed to be fixed directly to a helmet.

The attachment device of FIG. 1 includes a bearing housing 10 consisting of a base 12, a rotatable plate 14 and an adjusting cover 16. The base 12 is mounted between the plate 14 and the cover 16, which latter are united by means of a central self-tapping screw 18. The screw 18 passes through a depression 20 in a hub section 22 of the plate 14 and into a matching hub section 24 in the cover 16. The plate 14 rests directly on the base 12, a peripheral flange 26 of which encloses the outer edge 28 of the plate. The outer flange 30 of the cover 16 rests on the inside of a matching supporting flange 32 of the base 12, and there is also direct bearing contact between a supporting annular edge 34 of the outer flange 30 of the cover 16 and the edge 36 of the supporting flange of the base 12. It should be noted that the cover 16 and the plate 14 are together rotatable with respect to the base 12.

An arm 38, designed to carry an earmuff (not illustrated) at one end, passes through an opening 40 in the bearing housing 10, with part of the edge of the opening in the housing acting as an arm support. The said edge is provided with a bearing projection 42 facing the inside of the housing 10 and designed to engage with a matching bearing groove (not illustrated) in the arm 38. A separate spring component 44, consisting in the present case of a resilient metal ring, is supported under prestressing to turn, at one side, in a groove 46 in an adjustable spring support 48 located in the housing, and, at the diametrically opposed side, in a recess 60 in the end 52 of the arm located inside the housing. Thus the end 52 of the arm is subjected to a force directed away from the spring support 48, whereby two clearly defined positions of the arm can be obtained, namely, a stationary rest position and a position in which the earmuff exerts pressure around an ear. In the stationary position the end 52 of the arm 38 rests against the inside of the base 12. A separate stop 54 projecting from the base is provided to define a limit to the rocking motion of the arm away from its stationary position.

The spring support 48 consists of a rocker supported in the base 12 and the spring component 44 is supported in the end of the rocker farther from the base 12. The prestressing force of the annular spring 44 mounted between the rocker 48 and the end 52 of the arm causes the end 56 of the rocker to press against the inside of the outer flange 30 of the adjusting cover 16. The flange 30 is shaped so that its thickness varies along the extension thereof. This has the result that turning of the adjusting cover 16, and hence also of the plate 14, alters the adjustment of the rocker 48 with respect to (its distance from) the flange 32 of the base 12. This makes it possible to alter the prestressing of the annular spring 44 and hence the pressure exerted by the muff around the wearer's ear.

With the exception of the self-tapping screw 18 and the annular spring 44, all the components of the above design are preferably to be made of hard plastic.

The adapter 58 belonging to the fastening device is also made of plastic. The adapter, illustrated in FIG. 2, is provided with two through holes 60 enabling it to be fastened directly to the helmet by means of screws (not illustrated). Those parts 62 of the adapter through which the said holes 60 extend are comparatively thick, so that the material will not fail when the screws are tightened. The part of the adapter 58 nearest the edge of the helmet is provided with projections 64 which facilitate the fixing of the adapter in the intended position with respect to the helmet.

The central part of the adapter comprises a flat section 66 cut out in such a way that two ears 68 define an opening 70 sized to snugly fit the hub of the plate 14. Inasmuch as the ears 68 are slightly resilient the hub 22 will be grasped and retained with sufficient force to prevent the parts from being unintentionally separated. The part of the adapter 58 facing away from the edge of the helmet is provided with a collar 72 designed to rest in part of the outer circumference of the base 12 in order to locate the said parts with respect to each other. An advantage of the design illustrated is that an impact or blow striking the bearing housing 10 from above causes the housing to come loose immediately from the adapter 58. In a design with the housing more rigidly united to the adapter such an impact or blow may cause serious injury, e.g. as a result of the entire helmet being knocked off the wearer's head.

It is naturally possible to modify the invention within the terms of the following claims. Thus, for example, the form of the spring component is in no way critical. However, the annular form described above has been found to have certain advantages in connection with the assembly of the fastening device.

I claim:

1. An attachment device including a bearing housing (10) designed for mounting on a helmet, and an arm (38) which projects through an opening (40) in the housing, is supported by means of an arm support (42) therein, and serves to carry, at the end opposite the housing, an earmuff to be moved manually with a rocking motion between a stationary rest position and a position wherein the earmuff exerts a given desired pressure around the wearer's ear, characterized in that a separate spring component (44) at two opposite sides thereof is pivotally mounted at its periphery partly in a spring support (48), which is adjustably mounted in the housing and which remains stationary during the rocking motion of the arm, and partly in the inner end (52) of the arm (38) that is located inside the housing, said spring being prestressed or biased between said spring support and said inner end, thus exerting upon said inner end of the arm a force directed away from the spring support (48) for the purpose of stabilizing the arm in its two positions.

2. An attachment device as claimed in claim 1, characterized in that the spring element (44) is annular.

3. A device as claimed in claim 1, characterized in that the arm support comprises a part (42) of the surrounding edge of said opening (40) in the housing.

4. A device as claimed in claim 3, characterized in that the edge of said opening constituting the arm support has a projection (42) facing the inside of the bearing housing and arranged to engage with a matching groove in the arm (38).

5. A device as claimed in claim 1, characterized in that the spring support comprises a rocker (48) and that the position of the part (56) of the rocker in which the spring component (44) is supported is adjustable against an adjusting means with respect to the inner end (52) of the arm to permit alteration of the prestressing of the spring component.

6. A device as claimed in claim 5, characterized in that the adjustment means comprises a cover (16) having an annular collar (30) of thickness varying along the extension thereof and bearing at one side on the inside of the ring flange (32) of a base (12), which is rotatable with respect to the said adjusting cover, and at its opposite side against said part of the rocker in which the spring component is supported.

7. A device as claimed in claim 1, characterized in that the attachment device also comprises an adapter (58) designed to be screwed directly to the helmet, and that the bearing housing (10) and adapter (58) are united by means of a hub (22) projecting from the housing and designed to be retained by the grasping action of matching, resilient ears (68) formed in the adapter, one section of the circumference of the base (12) of the housing being in contact with a matching guiding flange (72) which projects from the adapter.

8. A device as claimed in claim 7, characterized in that the hub (22) projects from a plate (14) which is rotatable with respect to the base (12) and is rigidly united to an adjusting cover (16) on the housing by a central self-tapping screw (18).

9. A device as claimed in claim 8, characterized in that stops are provided on the base (12) to limit the rocking motion of the arm (38).

* * * * *